US007641161B2

(12) United States Patent
Bauer

(10) Patent No.: US 7,641,161 B2
(45) Date of Patent: Jan. 5, 2010

(54) BATHROOM ACCESSORY MOUNTING ASSEMBLY AND METHOD OF MOUNTING

(75) Inventor: Alan Bauer, Medina, OH (US)

(73) Assignee: Moen Incorporated, North Olmsted, OH (US)

( * ) Notice: Subject to any disclaimer, the term of this patent is extended or adjusted under 35 U.S.C. 154(b) by 790 days.

(21) Appl. No.: 10/709,814

(22) Filed: May 28, 2004

(65) Prior Publication Data

US 2005/0263655 A1 Dec. 1, 2005

(51) Int. Cl.
*A47B 96/00* (2006.01)

(52) U.S. Cl. ..... 248/221.11; 248/222.13; 403/326

(58) Field of Classification Search ..... 248/310, 248/314, 315, 231.91, 251, 221.11, 222.11, 248/222.13; 211/88.04, 85.12, 16; 24/297; 411/508, 509, 510, 913; 403/326, 329, 361
See application file for complete search history.

(56) References Cited

U.S. PATENT DOCUMENTS

| | | | | |
|---|---|---|---|---|
| 1,249,955 | A | 12/1917 | Hendrickson et al. | 248/216.4 |
| 1,280,244 | A | 10/1918 | Kroedel | 211/123 |
| 1,838,935 | A | 12/1931 | Fixsen | 248/222.5 |
| 1,915,230 | A | 6/1933 | Hooper | 248/221.11 |
| 2,144,602 | A * | 1/1939 | Balmer | 248/250 |
| 2,455,606 | A | 12/1948 | Pleiss | 248/250 |
| 2,893,676 | A | 7/1959 | Connors et al. | |
| 3,596,861 | A | 8/1971 | Baldini | |
| 4,566,662 | A * | 1/1986 | Toshishige | 248/222.14 |
| 4,979,713 | A * | 12/1990 | Bell | 248/224.8 |
| 5,135,036 | A * | 8/1992 | Caron | 144/286.5 |
| 5,145,135 | A * | 9/1992 | Thompson | 248/201 |
| 5,536,917 | A | 7/1996 | Suppelsa et al. | 219/201 |
| 5,590,974 | A * | 1/1997 | Yang | 403/327 |
| 5,799,804 | A | 9/1998 | Sharpe | 211/105.1 |
| 5,894,610 | A | 4/1999 | Winter et al. | |
| 6,244,549 | B1 * | 6/2001 | Ching | 248/222.14 |
| 6,250,597 | B1 * | 6/2001 | Kuo | 248/231.91 |
| 6,520,463 | B1 | 2/2003 | Ouano | 248/222.1 |
| 6,817,044 | B1 * | 11/2004 | Ouyoung | 4/576.1 |
| 2002/0023993 | A1 * | 2/2002 | Fleischmann et al. | 248/315 |
| 2002/0104946 | A1 | 8/2002 | Lai | 248/316.8 |

FOREIGN PATENT DOCUMENTS

| | | | |
|---|---|---|---|
| AU | 633 416 | B2 | 1/1993 |
| DE | 299 06 432 | U1 | 8/1999 |
| DE | 299 20 923 | U1 | 3/2000 |
| GB | 2 388 883 | A | 11/2003 |
| WO | WO 92/09230 | A | 6/1992 |

OTHER PUBLICATIONS

EP Search Report dated Feb. 6, 2006 for EP 05253274.4.

* cited by examiner

*Primary Examiner*—A. Joseph Wujciak, III
(74) *Attorney, Agent, or Firm*—Calfee, Halter & Griswold LLP

(57) ABSTRACT

A bathroom accessory mounting assembly and method of mounting are provided. The mounting assembly includes a mounting bracket, fastener, flange and post. The mounting bracket includes an axially extending body portion that receives the post. The mounting bracket includes a snap flange that cooperates with the post to secure the post to the mounting bracket.

5 Claims, 3 Drawing Sheets

BATHROOM ACCESSORY MOUNTING ASSEMBLY AND METHOD OF MOUNTING

BACKGROUND OF INVENTION

The present invention relates to a mounting assembly, and more specifically to a mounting assembly and a method of mounting bathroom accessories.

Bathroom accessories, such as, for example, towel racks, towel rings, and tissue holders, are typically attached to a wall by a mounting assembly comprising a mounting bracket, a flange, a mounting post and one or more fasteners. Traditional mounting assemblies are attached by using multiple fasteners to attach the mounting bracket to the wall and then securing the mounting post, typically with an integral flange, to the mounting bracket with an additional fastener. Mounting bathroom accessories in this fashion can be very time consuming, especially if a whole collection needs to be mounted. In order to make it easier to mount bathroom accessories, some mounting assemblies have been developed with snap-together features. However, the snap-together features of the prior art have traditionally required elaborate features that require substantial alignment effort and complex manipulation of the components to effectuate the mounting of the assembly. Additionally, the snap-together features require interaction with the flange of the post, thereby requiring an integral flange. Since the flange is a decorative component, it is desirable to provide a mounting assembly that allows interchangeable flanges.

SUMMARY OF INVENTION

The present invention relates to a mounting assembly for a bathroom accessory and a method of mounting a bathroom accessory. The mounting assembly provides an easy way to secure the bathroom accessory. The mounting assembly provides for snap assembly which facilitates easy assembly. In one embodiment the mounting assembly includes a mounting bracket, fastener, flange and post. The mounting bracket, fastener and flange can be preassembled to form a mounting subassembly. In such an embodiment, the accessory is mounted to a wall or other mounting point by securing the mounting subassembly to the mounting point, aligning the post with the mounting bracket, and moving the post axially along the mounting bracket until the post snaps into place.

BRIEF DESCRIPTION OF DRAWINGS

The present invention will be more fully understood by reference to the following detailed description of the invention and the accompanying drawings. The drawings represent exemplary embodiments of the present invention and are included for illustrative purposes in order to facilitate understanding of the description. Other embodiments of the present invention contemplated by the description are included within this application to the extent they fall within the scope of the claims attached hereto.

DETAILED DESCRIPTION

Figure 1:
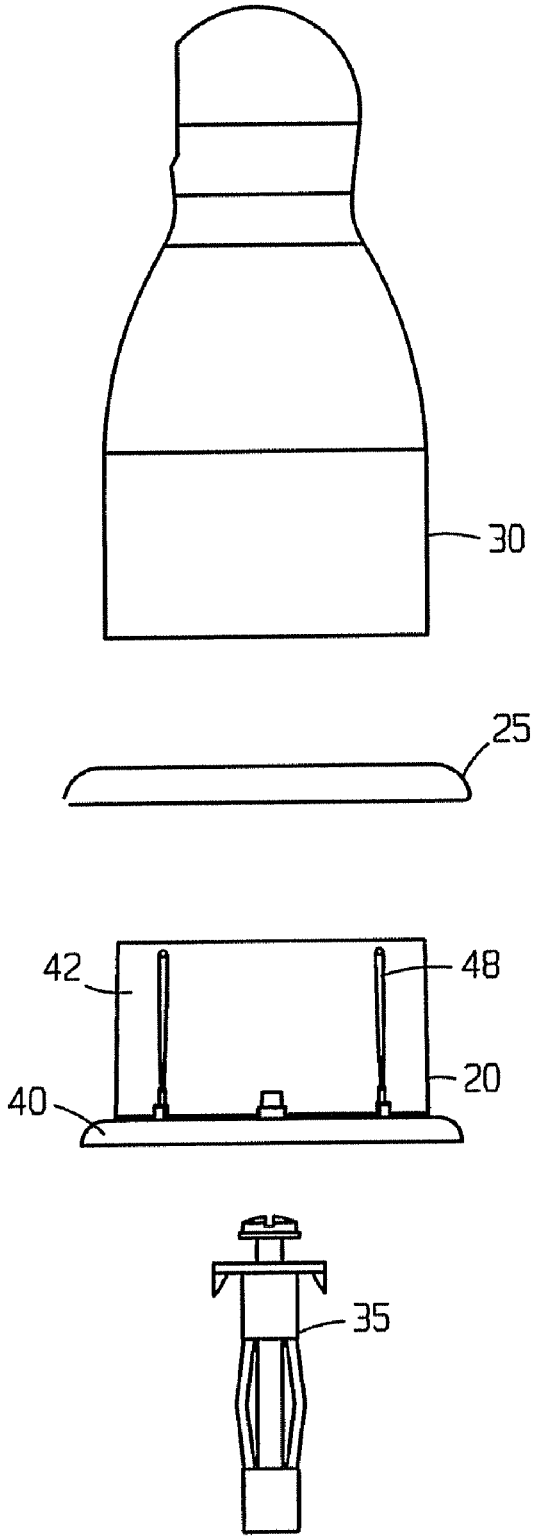
FIG. 1 is an exploded plan view of a bathroom accessory mounting assembly of the present invention.

The present invention includes a mounting assembly for bathroom accessories and a method for mounting bathroom accessories. The mounting assembly 10 includes a mounting bracket 20, a flange 25, a post 30 and a fastener 35. The mounting assembly 10 provides for easy and quick assembly and allows for interchangeability of the flange.

The mounting bracket 20 is generally cylindrical, although other geometrical shapes are contemplated by the invention. The mounting bracket 20 includes a base portion 40, a body portion 42, one or more snap-flanges 45, one or more retaining flanges 47 and one or more ribs 48.

The base portion 40 is generally cylindrical and fairly thin. The base portion 40 includes a mounting surface 50 with at least one mounting aperture 52 through which a fastener 35 is placed. As shown in the figures, an anchor is used as the fastener 35, however, it should be appreciated that other fasteners, such as, for example, screws, bolts and the like can be used. The body portion 42 is generally toroidal and extends axially outward from the base portion 40. The body portion 42 is generally hollow, but has a thickness appropriate to provide the requisite strength and durability. The ribs 48 run axially along the outer surface of the body portion 42 and provide a friction fit with the post 30 as described in further detail below.

The body portion 42 further includes a snap-flange 45 that is positioned in a u-shaped cutout 52 that penetrates through a section of the body portion. The snap flange 45 is generally rectangularly shaped, although other geometries are possible, with a main section 54 and an extended section 56. The main section 54 is attached to the body portion 42 of the mounting bracket 20 in the middle of the cut-out 52, thereby forming the u-shape of the cutout. The main section 54 of the snap flange 45 is long enough to allow flexure of snap flange 45. The extended portion 56 is located at one end of the snap flange 45 and generally is comprised of a camming surface 57 that extends radially beyond the outer periphery of the body portion 42. When the post 30 is placed over the mounting bracket 20, the inner surface of the post not only forms a friction fit with the ribs 48 of the mounting bracket, but also forces the extended section 56 of the snap flange 45 inward as the inner surface contacts the camming surface 57. The snap flange 45 will remain inwardly flexed until the extended section 56 of the snap flange 45 aligns with snap recess 60 located in the post 30. Once the extended section 56 of the snap flange 45 aligns with snap recess 60 located in the post 30, the extended section 56 penetrates the snap recesses 60, thereby securing the post 30 to the mounting bracket 20.

The body portion 42 may also include a retaining flange 47 which allows the flange 25 to be snapped into position on the mounting bracket 20. The retaining flange 47 is generally comprised of the camming surface 62 that extends radially beyond the outer periphery of the body portion 42. When the flange 25 is placed over the body portion 42 of the mounting bracket 20, the camming surface 62 contacts the inner surface of the flange 25. The inner surface of the flange 25 forces the retaining flange 47 inward thereby allowing axial advancement of the flange 25 over the body portion 42 of the mounting bracket 20. The flange 25 contains a recess 64, which when aligned with the retaining flange 47, allows the retaining flange to unflex, thereby snapping the flange 25 into place on the mounting bracket 20.

Figure 2:
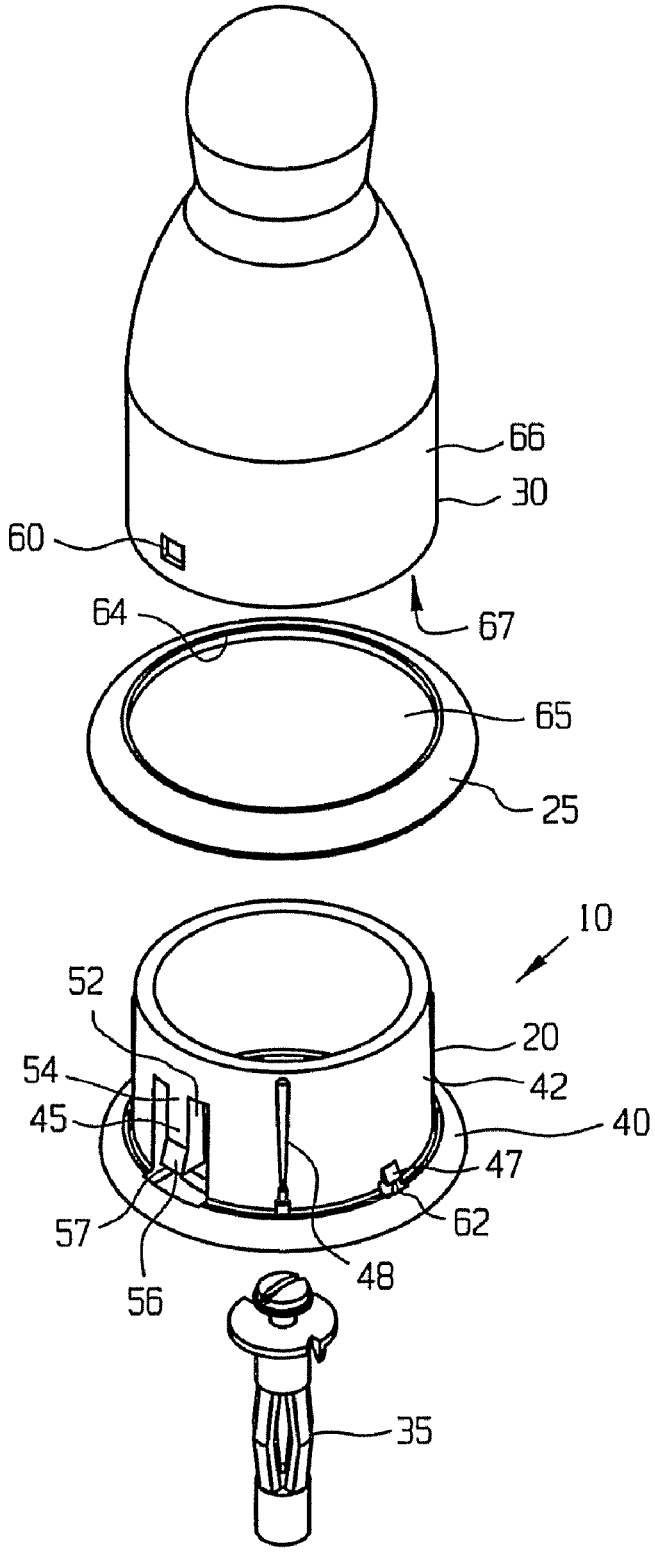
FIG. 2 is an exploded perspective view of a bathroom accessory mounting assembly of the present invention.
Figure 3:
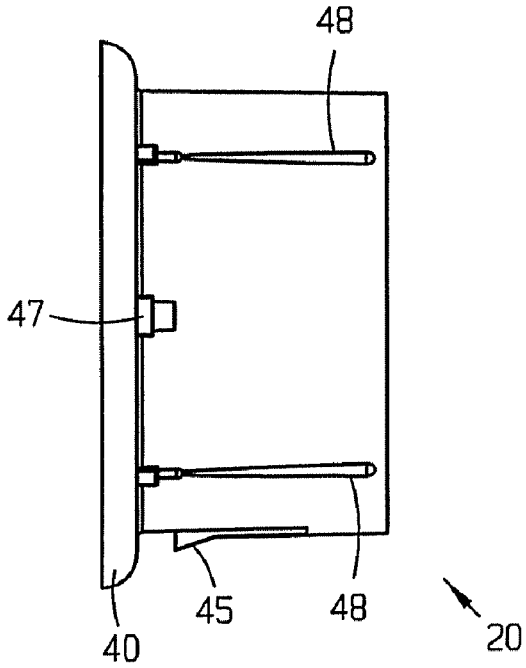
FIG. 3 is a side plan view of a mounting bracket of the present invention.
Figure 4:
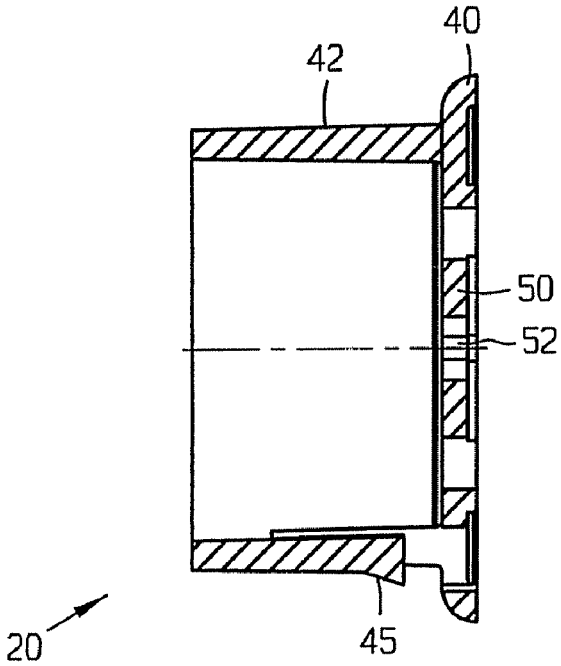
FIG. 4 is a cross-sectional view of the mounting bracket shown in FIG. 4.

The flange, or escutcheon 25 is generally a decorative piece that snaps on over the body portion 42 of the mounting bracket 20. In some embodiments, the flange 25 is an integral piece with the post 30. In other embodiments, the flange 25 is a separate piece that includes a centered circular aperture 65 that is slightly larger than the outer diameter of the body portion 42 of the mounting bracket 20. When the flange 25 is a separate piece, as shown in FIGS. 1 and 2, the flange 25 fits over the body portion 42 of the mounting bracket 20 until the retaining flange 47 snaps the flange into position on the mounting bracket.

The post 30 is generally a decorative piece that snaps on over the body portion 42 of the mounting bracket 20. The post 30 includes a toroidal body portion 66 that has a inner diameter that is slightly larger than the outer diameter of the body portion 42 of the mounting bracket 20. The post 30 also includes a central cavity 67 into which the mounting bracket 20 is disposed thereby hiding the mounting bracket from view. The inner surface of the post 30 forms a friction fit with ribs 48 of the mounting bracket 20. Furthermore, the inner surface of the post 30 contacts the camming surface 57 of the snap flange 45 forcing it inward and allowing the post to advance axially over the body portion 42 of the mounting bracket 20. When the post 30 is properly mounted, the snap recess 60 aligns with the extended portion 56 of the snap flange 45 and allows the snap flange 45 to unflex. Once the snap flange 45 unflexes, the post 30 is snapped into position on the mounting bracket 20. The snap recess 60 may penetrate through the post 30, as shown in FIG. 2, or it may only penetrate partially through the post. When the snap recess penetrates through the post 30, the post can be removed by applying radial force to the extended portion 56 of the snap flange 45 while applying axial force on the post.

To mount an accessory with the mounting assembly 10 of the present invention, the mounting bracket 20 is secured to the wall, or other point of attachment, with the fastener 35. Generally, the fastener 35 can be attached to the mounting bracket 20 prior to mounting to allow for easier assembly. The flange 25 is then placed over the body portion 42 of the mounting bracket 20 and snapped into position by the retaining flange 47. The post 30 is then slid over the body portion 42 of the mounting bracket 20 and snapped into position by the snap flange 45. In order to snap the post 30 into position, the snap flange 45 must be aligned with the snap recess 60 on the post 30. This can either be done while the post 30 is being slid into position on the mounting bracket 20, or can be done by rotating the post 30 about the mounting bracket 20 once positioned on the mounting bracket 20. In one method of method of mounting an accessory, the fastener 35, the mounting bracket 20, and the flange 25 are preassembled. This allows an assembler to simply anchor the fastener, mounting bracket and flange subassembly and then push the post 30 on over the subassembly to snap it into position and then move on to the next mounting assembly. Using this method of mounting greatly reduces the time required to assemble and mount an accessory.

The detailed description has been provided for clearness of understanding of the present invention and is not intended to unnecessarily limit the scope of the invention. Modifications will be obvious to those of ordinary skill in the art, and such modifications are intended to be included as part of this invention to the extent they fall within the scope of the claims attached hereto.

The invention claimed is:

1. A bathroom accessory mounting assembly for supporting bathroom accessories, such as towel racks, towel rings, and tissue holders, comprising:

a mounting bracket which includes an axially extending body portion;

an accessory post that mounts on said axially extending body portion by sliding movement of an inner surface of said accessory post along an outer surface of said axially extending body portion;

wherein said mounting bracket includes a snap flange located on said axially extending body portion, said snap flange including a camming surface that engages said inner surface of said accessory post to flex said snap flange;

wherein said accessory post includes a recess extending therethrough for receiving a portion of said snap flange when said accessory post is properly positioned on said mounting bracket, receipt of said portion of said snap flange in said recess allowing said snap flange to unflex, thereby facilitating secure attachment of said accessory post to said mounting bracket;

wherein, to release secure attachment of said accessory post to said mounting bracket, said snap flange can be engaged from the exterior of said accessory post to flex said portion of said snap flange out of said recess; and wherein said snap flange includes a main portion that is integral to said body portion, said main portion formed in a cutout region of said body portion such as to provide a u-shaped cutout in said body portion.

2. The bathroom accessory mounting assembly of claim 1, further comprising a flange that mounts on said axially extending body portion of said mounting bracket.

3. The bathroom accessory mounting assembly of claim 1, wherein said accessory post includes a generally toroidal portion defined by an inner diameter and an outer diameter and a thickness therebetween, wherein said axially extending body portion is generally toroidal and is defined by an inner diameter and an outer diameter and a thickness therebetween; wherein said inner diameter of said accessory post is slightly larger than the outer diameter of said axially extending body portion of said mounting bracket to form a friction fit between the accessory post and the mounting bracket.

4. The bathroom accessory mounting assembly of claim 1, wherein said mounting bracket further comprises one or more ribs located on said axially extending body portion.

5. A bathroom accessory mounting assembly for supporting bathroom accessories, such as towel racks, towel rings, and tissue holders, comprising:

a mounting bracket which includes an axially extending body portion;

an accessory post that mounts on said axially extending body portion by sliding movement of an inner surface of said accessory post along an outer surface of said axially extending body portion; and a flange that mounts on said axially extending body portion of said mounting bracket, wherein said mounting bracket includes a snap flange located on said axially extending body portion, said snap flange including a camming surface that engages said inner surface of said accessory post to flex said snap flange;

wherein said accessory post includes a recess extending therethrough for receiving a portion of said snap flange when said accessory post is properly positioned on said mounting bracket, receipt of said portion of said snap flange in said recess allowing said snap flange to unflex, thereby facilitating secure attachment of said accessory post to said mounting bracket;

wherein, to release secure attachment of said accessory post to said mounting bracket, said snap flange can be engaged from the exterior of said accessory post to flex said portion of said snap flange out of said recess; and wherein said mounting bracket further comprises a retaining flange located along a periphery of said body portion for securing said flange to said mounting bracket.

* * * * *

UNITED STATES PATENT AND TRADEMARK OFFICE

CERTIFICATE OF CORRECTION

PATENT NO. : 7,641,161 B2
APPLICATION NO. : 10/709814
DATED : January 5, 2010
INVENTOR(S) : Alan Bauer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 993 days.

Signed and Sealed this

Twenty-first Day of December, 2010

David J. Kappos

David J. Kappos
*Director of the United States Patent and Trademark Office*